United States Patent [19]

Goedderz, Sr.

[11] Patent Number: 4,713,179

[45] Date of Patent: Dec. 15, 1987

[54] REMOVABLE CULVERT GRATE

[76] Inventor: Stanley J. Goedderz, Sr., Star Rte., Box 355, Deerwood, Minn. 56444

[21] Appl. No.: 839,689

[22] Filed: Mar. 14, 1986

[51] Int. Cl.[4] ..... B01D 35/28; E02B 5/08

[52] U.S. Cl. ..... 210/747; 210/155; 210/162; 210/170; 210/237; 405/125

[58] Field of Search ..... 210/155, 162, 163, 164, 210/170, 237, 747; 404/2; 405/125, 127, 74, 124; 49/57, 58

[56] References Cited

U.S. PATENT DOCUMENTS

| | | | |
|---|---|---|---|
| 543,961 | 8/1895 | Hayward | 210/164 |
| 693,511 | 2/1902 | Garrett et al. | 210/163 |
| 1,420,283 | 6/1922 | Randlett | 210/162 |
| 2,102,310 | 12/1937 | Egan | 210/237 |
| 3,086,655 | 4/1965 | Compton | 210/153 |
| 3,472,030 | 10/1969 | Rieke | 405/125 |
| 3,587,239 | 6/1971 | Feland | 405/125 |
| 4,042,506 | 8/1977 | Wilson | 210/155 |

FOREIGN PATENT DOCUMENTS

| | | | |
|---|---|---|---|
| 2711141 | 9/1978 | Fed. Rep. of Germany | 210/159 |
| 60949 | 11/1936 | Norway . | |
| 435872 | 10/1935 | United Kingdom | 210/164 |
| 1588677 | 4/1981 | United Kingdom | 210/164 |

OTHER PUBLICATIONS

"California Culvert Practice", California Highways and Public Works, 1943, pp. 12–21.

*Primary Examiner*—Ernest G. Therkorn
*Assistant Examiner*—Linda S. Evans
*Attorney, Agent, or Firm*—Gregory P. Kaihoi; James R. Haller

[57] ABSTRACT

A removable culvert grate for placement adjacent the inflow end of a culvert. The grate includes a vertical grate having a plurality of slats to prevent the flow of beaver workings or similar debris therethrough, and a horizontal platform extending outwardly from the lower edge of the vertical platform. A linkage bar is provided extending from the upper edge of the vertical grate for connection to a power source such as a winch. The grate may be placed adjacent the inflow of a culvert, and, after beavers have constructed a dam or similar debris has collected against the vertical grate, the unit may be lifted by a winch carried in a pick-up truck or similar vehicle, carrying with it the debris.

10 Claims, 3 Drawing Figures

REMOVABLE CULVERT GRATE

FIELD OF THE INVENTION

This invention relates to a grate of the type used to cover openings to water passageways such as culverts. More specifically, the invention relates to the type of grate which is removable from the end of a culvert.

BACKGROUND OF THE INVENTION

To preserve proper drainage of water, culverts are frequently installed through any road or other embankment which otherwise interferes with the natural drainage of the land. In areas where beavers are active, however, the inlet side of such a culvert provides a desirable location for beavers to construct a dam. Culverts usually are of a relatively smaller cross-section than the ditch or waterway, and are therefore relatively easy for beavers to completely obstruct. Not only will beavers build dams across the openings of such culverts, but frequently they will carry their workings into the culverts as well.

For a variety of environmental and economic reasons, beaver dams must be cleared from culverts to allow proper water drainage. Failure to remove dams can cause localized flooding and inhibits or interferes with established land uses. Removal of dams is labor-intensive and costly, however. It is often difficult and/or expensive to utilize construction equipment (such as a backhoe), and manual methods are understandably undesirable. Furthermore, if beavers have built a dam into the culvert, it can be removed only by hand, painstakingly, or by expensive horizontal boring equipment. In some instances the only solution is to actually replace the entire culvert, an extremely expensive and undesirable solution. This situation is compounded by the industriousness of beavers; it is not uncommon for beavers to entirely obstruct a given culvert within 24 to 48 hours after it has been cleared by a crew of workmen.

Past efforts at remedying this problem have frequently been directed toward trapping or otherwise controlling the beavers themselves. These solutions are not entirely effective, and are offensive to certain segments of society.

SUMMARY OF THE INVENTION

The invention provides a removable culvert grate for placement adjacent to the in-flow end of a culvert. The unit includes a generally vertical grate for placement adjacent to the inflow end of the culvert, the grate having an upper and a lower edge and effectively preventing adult beavers and beaver workings from passing therethrough. The culvert grate also includes a generally horizontal platform extending from the lower edge of the vertical grate in a direction away from the culvert. Linkage means is provided for attachment to a power source to lift the culvert grate vertically, carrying with it any debris or beaver workings collected above the platform.

The invention also relates to a method of clearing debris away from the inlet of a water passageway such as a culvert comprising steps of providing a removable culvert grate having a vertical grate which permits the flow of water therethrough while substantially preventing the flow of debris therethrough and further includes a horizontal platform joined to the vertical grate at the lower edge thereof, forming generally a right angle therewith; placing the culvert grate adjacent the inlet of the passageway with the platform extending away from the inlet; allowing debris to collect adjacent the vertical grate and above the horizontal platform; and lifting the culvert grate away from the opening, the horizontal platform carrying with it the debris.

BEST MODE FOR CARRYING OUT THE INVENTION

Figure 1:
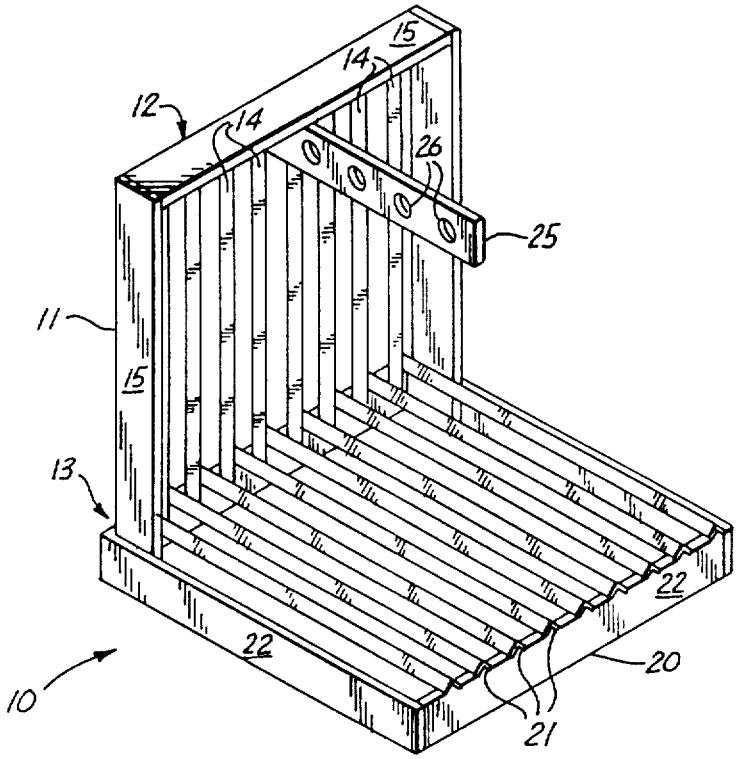
FIG. 1 is a perspective view of the removable culvert grate of the invention.
Figure 2:
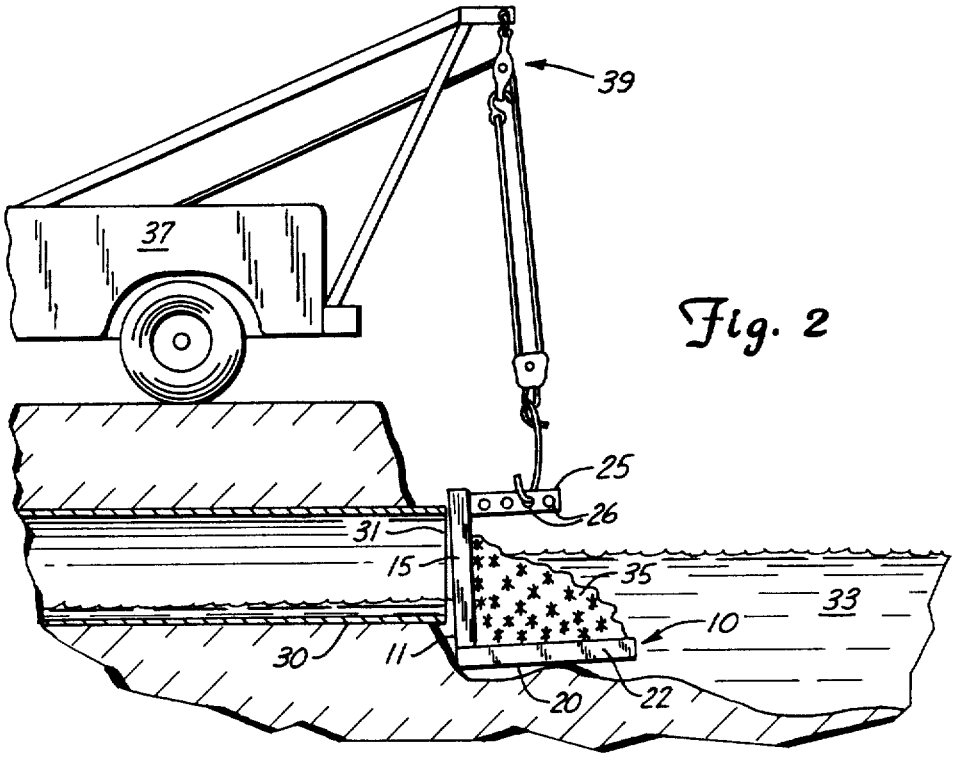
FIG. 2 is a side elevational view, in partial cross-section, showing the removable culvert grate of the invention in use.
Figure 3:
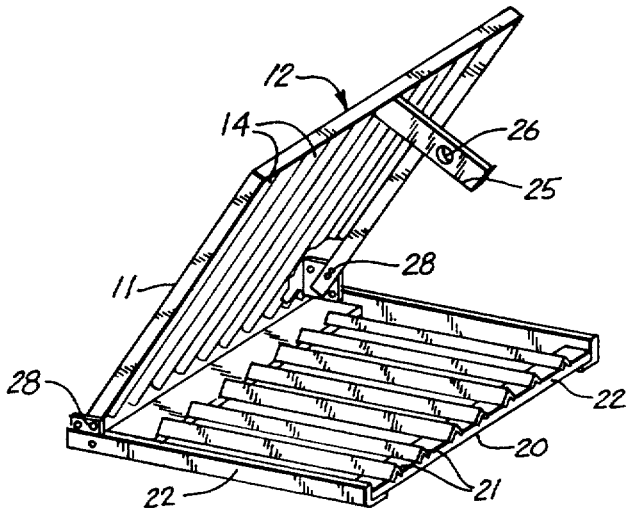
FIG. 3 is a perspective view of a removable culvert grate of the invention.

Referring to FIG. 1, a removable culvert grate (10) includes a vertical grate (11) and a horizontal platform (20). The vertical grate (11) includes a frame (15) having an upper edge (12), a lower edge (13), and a plurality of slats (14) spaced to effectively prevent beaver workings and adult beavers from passing therethrough. In the preferred embodiment shown in FIG. 1 the slats (14) are constructed from one-quarter inch by one inch by one inch steel welded on three-inch centers to a steel frame, leaving approximately 1.6 inches between slats. Other spacings and configurations might also be used, including horizontal, diagonal, or mesh, so long as the vertical grate permits the flow of water therethrough while preventing beavers and beaver workings from passing therethrough.

Extending generally perpendicular from the lower edge (13) of the vertical grate (11) is the horizontal platform (20). The horizontal platform (20) depicted in FIG. 1 is comprised essentially of a frame (22) and a plurality of parallel slats (21). The platform functions to lift out the beaver workings, and as such may be constructed from a variety of suitable materials and configurations. For example, the slats (21) could run in any direction; alternately the platform could be constructed of a mesh or even a solid material. Although the culvert grate shown in the drawings is rigidly welded, a hinge may be provided to join the vertical and horizontal sections, to be conveniently folded for storage or transport.

Linkage means is provided for allowing the culvert grate (10) to be hoisted into and out of position. A preferred means is shown in FIG. 1 as a linkage bar (25) extending from the upper edge (12) of the vertical grate (11) generally in the same direction as the horizontal platform (20). The linkage bar (25) includes a plurality of holes (26) for receiving, for example, a hook suspended by a winch (39). The holes (26) are provided to allow the hook to be connected to the particular hole judged to be appropriate for lifting the unit without dumping any beaver workings (35) carried by the horizontal platform (20). It will be understood, however, that a single hole would suffice so long as it is properly positioned in relation to the center of gravity of the culvert grate (10).

In use, the culvert grate (10) of the invention may be suspended from a winch unit (39) carried by a pick-up truck (37) or any other suitable means. The grate may then be lowered into place adjacent the inlet end (31) of a culvert (30). After debris has collected against the grate, or after beavers have constructed a dam across the culvert, the winch may be connected to the linkage bar (25) and the unit hoisted out, carrying with it the debris or beaver workings (35). If the culvert grate (10) is lifted by a winch unit (39) on a pick-up truck (37), the workings (35) may then be transported to a suitable dumping ground, and the culvert grate (10) then returned to its position in front of the culvert.

In the drawings, the vertical grate (11) is shown as entirely covering the opening of the culvert (30). In some applications, particularly for very large culverts, it would not be necessary to entirely cover the culvert opening so long as the top of the vertical grate (11) is above the water (33) level and higher than the likely height of any beaver dam. Similarly, the width of the unit can be selected to suit the particular application, and is not necessarily wider than the culvert, although this is desirable.

In practice I have observed that beavers may construct an entire dam across a culvert in as little as a single day, and through use of the device of my invention, the beaver workings (35) may easily be removed as described above. After removing a culvert grate (10), it usually is not necessary to further clean the area prior to replacing the grate (10) in front of the culvert. The rush of water (33) through the culvert following removal of the culvert grate (10) tends to wash away any loose debris or workings which might otherwise have inhibited the replacement of the culvert grate (10).

The culvert grate (10) may be manufactured from any of a variety of well-known suitable material. Desirably, the unit is welded together from commonly available steel angle iron. For example, the frame for the horizontal platform and the vertical grate can be made from three inch by three inch by three-eighths inch angle, and the slats (14) and (21) can be made from one inch by one inch by one-quarter inch angle. Other suitable materials might also be used, however, including suitable plastics or fiberglass, aluminum, or similar strong material. Such other materials may provide additional advantages over steel in that they would not rust or corrode over time. It will be appreciated that the main restriction on material choice relates to strength and rigidity, and any materials meeting these requirements might be employed.

For ease of storage and transportation, the vertical grate (11) and horizontal platform (20) may be connected by hinge means (28), such as pivot bolt, to allow the culvert grate to be folded.

While a preferred embodiment of the present invention has been described, it should be understood that various changes, adaptations and modifications may be made therein without departing from the spirit of the invention and the scope of the appended claims.

What is claimed is:

1. A removable culvert grate for placement adjacent the inflow end of a culvert comprising:
   a. a generally vertical grate for placement adjacent the inflow end of a culvert, the grate having an upper and a lower edge;
   b. a generally horizontal platform extending from the lower edge of the grate; and
   c. linkage means attachable to a power source to allow the culvert grate to be lifted vertically by said power source carrying with it any debris collected above the platform, the linkage means comprising a bar extending from the upper edge of the vertical grate generally normal to the plane of the grate in the same direction as the horizontal platform.

2. The culvert grate of claim 1 wherein the vertical grate includes a plurality of parallel slats spaced to effectively prevent adult beavers from passing therebetween.

3. The culvert grate of claim 2 wherein the slats comprise angle irons.

4. The culvert grate of claim 1 further including hinge means connecting the vertical grate and the horizontal platform to allow the culvert grate to be folded.

5. The culvert grate of claim 1 wherein the horizontal platform includes a plurality of parallel, spaced slats.

6. The culvert grate of claim 5 wherein the slats comprise angle irons.

7. A removable culvert grate for placement adjacent the inflow end of a culvert comprising:
   a. a generally vertical grate for placement adjacent the inflow end of a culvert, the grate having an upper and a lower edge;
   b. a generally horizontal platform extending from the the lower edge of the grate; and
   c. linkage means attachable to a power source to allow the culvert grate to be lifted vertically by said power source carrying with it any debris collected above the platform, said linkage means comprising a bar extending from the upper edge of the vertical grate generally normal to the plane of the grate in the same direction as the horizontal platform, said bar including means defining a plurality of holes therein for receiving a linkage of the power source.

8. A removable culvert grate for placement adjacent the inflow end of a culvert comprising:
   a. a generally vertical grate for placement adjacent the inflow end of a culvert comprising: the grate having an upper and a lower edge and including a plurality of parallel slats spaced to effectively prevent adult beavers from passing therebetween;
   b. a generally horizontal platform extending from the lower edge of the grate and including a plurality of spaced slats; and
   c. linkage means attachable to a power source to allow the culvert grate to be lifted vertically by said power source carrying with it any debris collected above the platform, said linkage means comprising a bar extending from the upper edge of the vertical grate generally normal to the plane of the grate in the same direction as the horizontal platform and containing means defining a plurality of holes therein for receiving a linkage of the power source.

9. A method of clearing debris away from the inlet of a water passageway comprising the steps of:
   a. providing a removable grate assembly having a vertical grate which permits the flow of water therethrough while substantially preventing the flow of debris therethrough, a horizontal platform joined to the vertical grate at the lower edge thereof, forming a generally right angle therewith, and linkage means comprising a bar extending from the upper edge of the vertical grate generally normal to the plane of the grate in the same direction as the horizontal platform;
   b. placing the grate assembly adjacent the inlet of the passageway with the platform extending away therefrom;
   c. allowing debris to collect adjacent the vertical grate and above the horizontal platform; and
   d. lifting the grate assembly away from the opening by a power source attached to the bar, the horizontal platform carrying with it the debris.

10. The method of claim 9 wherein the lifting step includes the steps of attaching a winch to the bar and powering the winch to lift the grate assembly.

* * * * *

UNITED STATES PATENT AND TRADEMARK OFFICE

CERTIFICATE OF CORRECTION

PATENT NO. : 4,713,179

DATED : December 15, 1987

INVENTOR(S) : Stanley J. Goedderz, Sr.

It is certified that error appears in the above—identified patent and that said Letters Patent is hereby corrected as shown below:

Column 4, line 32, after "culvert" insert --,-- .
Column 4, line 32, delete "comprising:" .

Signed and Sealed this

Fourteenth Day of June, 1988

*Attest:*

*Attesting Officer*

DONALD J. QUIGG

*Commissioner of Patents and Trademarks*